US009457571B2

(12) United States Patent
Ge et al.

(10) Patent No.: US 9,457,571 B2
(45) Date of Patent: Oct. 4, 2016

(54) FLUID EJECTION APPARATUSES INCLUDING A SUBSTRATE WITH A BULK LAYER AND A EPITAXIAL LAYER

(71) Applicant: HEWLETT-PACKARD DEVELOPMENT COMPANY, L.P., Houston, TX (US)

(72) Inventors: Ning Ge, Palo Alto, CA (US); Chaw Sing Ho, Singapore (SG); Adam L. Ghozeil, Corvallis, OR (US); Michael W. Cumbie, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/890,551

(22) PCT Filed: Jun. 28, 2013

(86) PCT No.: PCT/US2013/048651

§ 371 (c)(1),
(2) Date: Nov. 11, 2015

(87) PCT Pub. No.: WO2014/209376

PCT Pub. Date: Dec. 31, 2014

(65) Prior Publication Data

US 2016/0129690 A1 May 12, 2016

(51) Int. Cl.

| | |
|---|---|
| ***B41J 2/145*** | (2006.01) |
| ***B41J 2/16*** | (2006.01) |
| *B41J 2/14* | (2006.01) |

(52) U.S. Cl.

CPC ..... *B41J 2/145* (2013.01); *B41J 2/14129* (2013.01); *B41J 2/162* (2013.01); *B41J 2/1603* (2013.01); *B41J 2/1626* (2013.01); *B41J 2/1628* (2013.01); *B41J 2/1629* (2013.01); *B41J 2/14* (2013.01); *B41J 2/14016* (2013.01); *B41J 2202/13* (2013.01)

(58) Field of Classification Search

None

See application file for complete search history.

(56) References Cited

U.S. PATENT DOCUMENTS

| | | | | |
|---|---|---|---|---|
| 6,622,373 | B1 * | 9/2003 | Tu | B41J 2/1404 216/27 |
| 6,746,107 | B2 * | 6/2004 | Giere | B41J 2/1404 347/65 |
| 7,125,731 | B2 | 10/2006 | Haluzak et al. | |
| 7,178,905 | B2 | 2/2007 | Shin et al. | |
| 7,607,759 | B2 | 10/2009 | Min et al. | |
| 8,141,987 | B2 | 3/2012 | Hayakawa et al. | |

(Continued)

OTHER PUBLICATIONS

Liou, J-C. et al.; "Design and Fabrication of Monolithic Multidimensional Data Registration CMOS/MEMS Ink-Jet Printhead"; Aug. 2010; pp. 961-972; vol. 19; Issue 4; http://ieeexplore.ieee.org/stamp/stamp.jsp?tp=&arnumber=5512544.

*Primary Examiner* — Lisa M Solomon

(74) *Attorney, Agent, or Firm* — HP Inc—Patent Department

(57) ABSTRACT

Examples of fluid ejection apparatuses and methods for making fluid ejection apparatuses are described. An example method may include forming a fluid feed slot in a bulk layer of a substrate, forming a plurality of ink feed channels in at least an epitaxial layer of the substrate, each of the ink feed channels fluidically coupled to the fluid feed slot, and forming a plurality of drop generators over the substrate such that the epitaxial layer of the substrate is between the plurality of drop generators and the bulk layer and such that the each of the drop generators is fluidically coupled to the fluid feed slot by at least one of the ink feed channels.

12 Claims, 8 Drawing Sheets

(56) References Cited

U.S. PATENT DOCUMENTS

| | | | |
|---|---|---|---|
| 2002/0122100 | A1 | 9/2002 | Nordstrom et al. |
| 2006/0232636 | A1 | 10/2006 | Bengali |
| 2008/0122896 | A1 | 5/2008 | Stephenson, III |
| 2011/0049092 | A1 | 3/2011 | Pan et al. |
| 2011/0205303 | A1 | 8/2011 | Pan et al. |

* cited by examiner

FLUID EJECTION APPARATUSES INCLUDING A SUBSTRATE WITH A BULK LAYER AND A EPITAXIAL LAYER

BACKGROUND

Drop-on-demand inkjet printers may include one of various types of actuators to cause ink droplets out of a printhead nozzles. Thermal inkjet printers, for example, may use inkjet printheads with heating element actuators that vaporize ink, or other print fluid, inside ink-filled chambers to create bubbles that force ink droplets out of the printhead nozzles. In at least some of these printheads, the actuators may be disposed on a substrate in proximity to a corresponding nozzle.

BRIEF DESCRIPTION OF THE DRAWINGS

The Detailed Description section references the drawings, wherein.

all in which various embodiments may be implemented.

Certain examples are shown in the above-identified figures and described in detail below. The figures are not necessarily to scale, and various features and views of the figures may be shown exaggerated in scale or in schematic for clarity and/or conciseness.

DETAILED DESCRIPTION

Printheads and their device features continue to decrease in size, which may pose a challenge when it comes to fabrication. An individual actuator of a printhead may be disposed on a substrate in proximity to a corresponding nozzle for ejecting fluid droplets from the printhead. Characteristics of the substrate may become a factor in device performance as the printhead becomes smaller. For instance, thermal flux may tend to increase with increasing substrate thickness, while fluidic flux may tend to increase with decreasing substrate thickness. The thermal issue may be a concern for silicon-on-insulator structures in which a substrate membrane supporting a thermal actuator is on an insulating buried oxide layer. The increase in temperature of the substrate may impact performance of other active devices on the substrate and/or pose a thermal uniformity issue for fluidics performance.

Described herein are implementations of fluid ejection apparatuses including a substrate with a bulk layer and an epitaxial layer, and methods for making the same. In some implementations, a fluid feed slot may be formed in a bulk layer of the substrate, and a plurality of ink feed channels may be formed in at least an epitaxial layer of the substrate, each of the ink feed channels fluidically coupled to the fluid feed slot. A plurality of drop generators may be formed over the substrate such that the epitaxial layer of the substrate is between the plurality of drop generators and the bulk layer and such that the each of the drop generators is fluidically coupled to the fluid feed slot by at least one of the ink feed channels. In various implementations, the epitaxial/bulk layer structure may allow for controlling the thickness of the substrate membrane on which actuators of the drop generators may be disposed, which may allow for mitigating thermal and/or fluidic flux.

Figure 1:
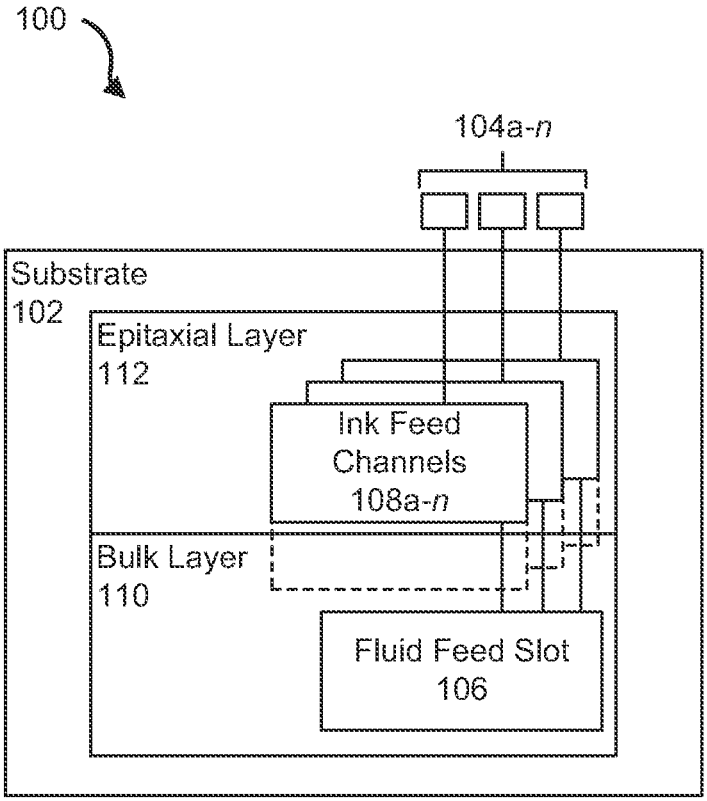
FIG. 1 is a block diagram of an example fluid ejection apparatus.

A block diagram of an example fluid ejection apparatus 100 is illustrated in FIG. 1. In various implementations, the apparatus 100 may comprise, at least in part, a printhead or printhead assembly. In some implementations, for example, the fluid ejection apparatus 100 may be an inkjet printhead or inkjet printing assembly.

As illustrated, the apparatus 100 includes a substrate 102, a plurality of drop generators 104*a-n*, a fluid feed slot 106, and a plurality of ink feed channels 108*a-n*. The substrate 102 includes a bulk layer 110 and an epitaxial layer 112 on the bulk layer 110, with the drop generators 104*a-n* over the substrate 102 such that the epitaxial layer 112 is between the drop generators 104*a-n* and the bulk layer 110. Each of the drop generators 104*a-n* is fluidically coupled to the fluid feed slot 106 by at least one of the ink feed channels 108*a-n*. The fluid feed slot 106 provides a supply of fluid to the drop generators 104*a-n* via the ink feed channels 108*a-n*.

As illustrated, the fluid feed slot 106 may be defined in the bulk layer 110 of the substrate 102, and the ink feed channels 108*a-n* may be defined, at least in part, in the epitaxial layer 112 of the substrate 102. In various implementations, the fluid feed slot 106 may be defined partly in the bulk layer 110 and partly in the epitaxial layer 112. In various implementations, the ink feed channels 108*a-n* may be defined wholly within the epitaxial layer 112, or partly in the bulk layer 110 and partly the epitaxial layer 112.

Figure 2:
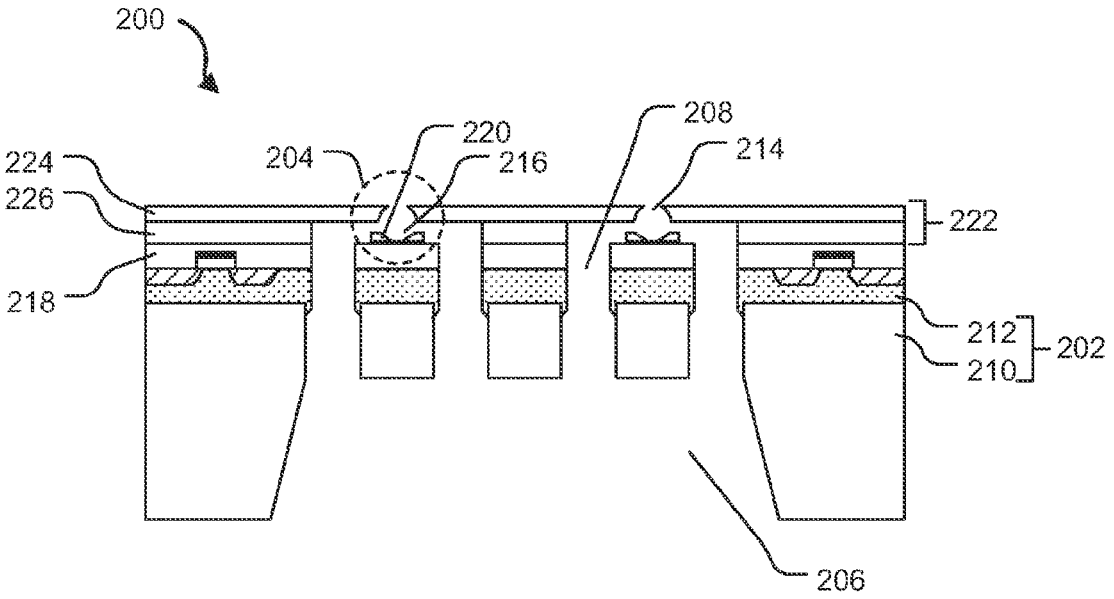
FIG. 2 is a sectional view of another example fluid ejection apparatus.

FIG. 2 is a sectional view of another fluid ejection apparatus 200. As illustrated, the substrate 202 includes a bulk layer 210 and an epitaxial layer 212 over the bulk layer 210. A fluid feed slot 206 is defined in the at least the bulk layer 210, and the ink feed channels 208 are defined partly in the epitaxial layer 212 and partly in the bulk layer 210. Drop generators 204 are disposed over the substrate 202 such that the epitaxial layer 212 is between the drop generators 204 and the bulk layer 210.

Each of the drop generators 204 includes a nozzle 214 and a vaporization chamber 216. The vaporization chambers 216 may fluidically couple the fluid feed slot 206 to corresponding ones of the nozzles 214. The drop generators 204 may also comprise a circuit layer 218 including an actuator 220 disposed on a portion of the substrate 202 and configured to cause fluid to be ejected from the vaporization chamber 216 through a corresponding one of the nozzles 214. As illustrated, each of the drop generators 204 is fluidically coupled with the fluid feed slot 206 by two ink feed channels 208 separated from each other by the portion of the substrate 202 supporting the actuator 220. In various implementations, the actuators 220 may comprise resistive or heating elements. In some implementations, the actuators 220 comprise split resistors or single resistors. Other types of actuators such as, for example, piezoelectric actuators or other actuators may be used for the actuators 220 in other implementations.

In various implementations, an orifice layer 222 may be supported by the substrate 202 and may define, at least in part, the nozzles 214 and vaporization chambers 216 of the drop generators 204. The orifice layer 222 may comprise a metal or polymer orifice plate 224 and a barrier layer 226 between the orifice plate 224 and the substrate 202 as illustrated. In various implementations, the orifice plate 224 may comprise metal or another material resistant to corrosion and/or mechanical damage. In various implementations, the orifice plate 224 may comprise a metal plate made of metal such as, but not limited to, nickel, gold, platinum, palladium, rhodium, titanium, or another metal or alloys thereof, or a polymer plate made a material such as, but not limited to, SU-8 or kaptone. In various implementations, the barrier layer 226 may comprise a polymer such as, for example, SU-8, or another suitable insulating material.

It is noted that although the various drawings herein depict apparatuses including some number of drop generators, in most implementations, fluid ejection apparatuses within the scope of the present disclosure may have multiple columns of drop generators, with multiple drop generators per column. Various other configurations may also be possible within in the scope of the present disclosure.

Various operations of methods for forming a fluid ejection apparatus including a substrate having a bulk layer and an epitaxial layer are illustrated in FIGS. 3-12 by way of sectional views of the apparatus at various stages of the methods. It should be noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

Figure 3:
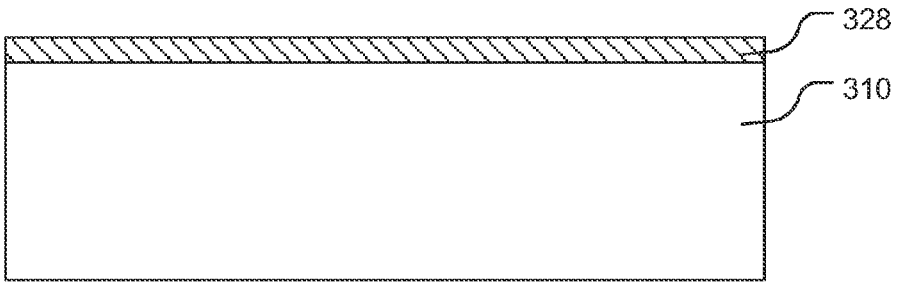
FIGS. 3-12 illustrate various stages of methods for forming another example fluid ejection apparatus.

Turning now to FIG. 3, a method for forming a fluid ejection apparatus including a substrate having a bulk layer and an epitaxial layer, in accordance with various implementations, may begin or proceed with depositing a mask 328 on a bulk layer 310. In various implementations, the bulk layer 310 may comprise, but is not limited to, silicon. In other implementations, the bulk layer 310 may comprise another material suitable for forming the substrate of the fluid ejection apparatus and for growing epitaxial material thereon. The mask 328 may comprise a hard mask such as, for example, silicon oxide, silicon nitride, or another mask material.

Figure 4:
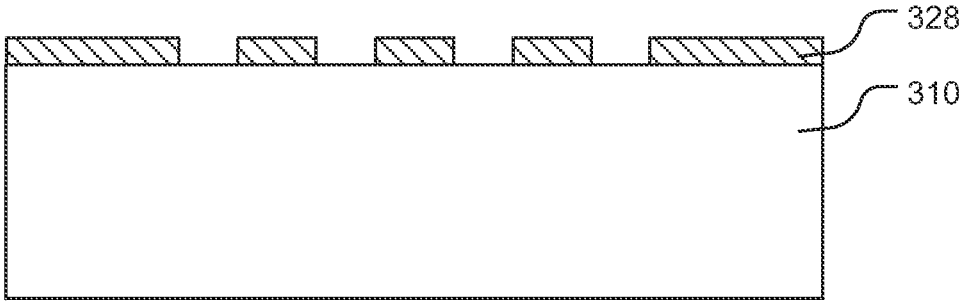
Figure 5:
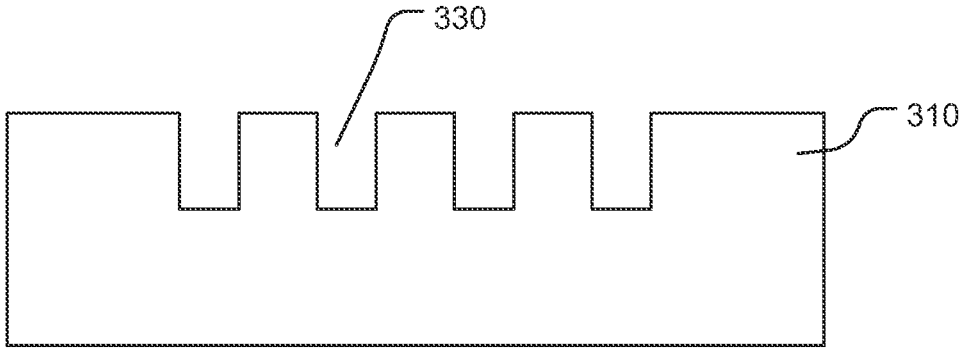

At FIG. 4, the mask 328 may be patterned to define locations as which the ink feed channels are to be formed, as discussed below, and then at FIG. 5, the trenches 330 may be formed in the bulk layer 310 and the mask 328 removed. In various implementations, the trenches 330 may be formed using a dry etch or another suitable etch operation. In various implementations, the trenches 330 may be formed to have a thickness in a range of about 10 μm to about 20 μm, though in other implementations, the trenches 330 may have a thickness outside this range depending on the ink feed channel height and bulk layer 310 thickness. In various implementations, a cleaning operation may be performed following removing of the mask 328.

Figure 6:
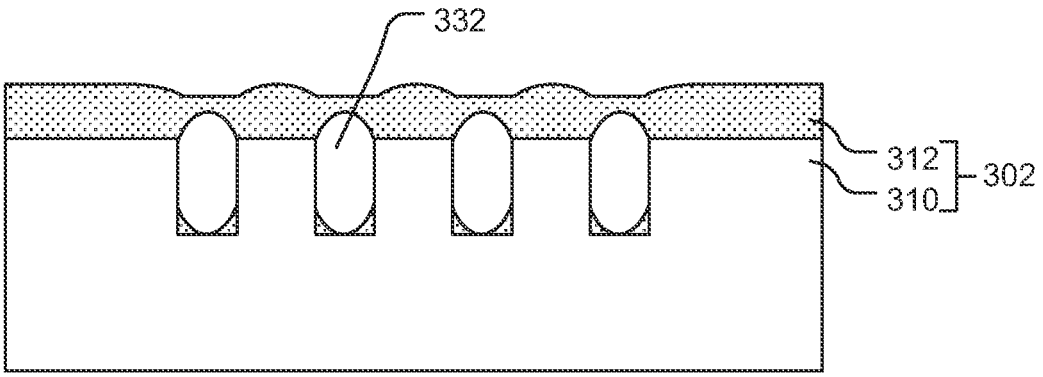

At FIG. 6, an epitaxial layer 312 may be formed over the trenches in the bulk layer 310 to form corresponding holes 332 in the substrate 302. As illustrated, the epitaxial layer 312 may grow laterally that the trenches join along the top to form the closed holes 332 in a lateral epitaxial overgrowth manner. In various implementations, the epitaxial layer 312 comprises silicon or another suitable material.

Figure 7:
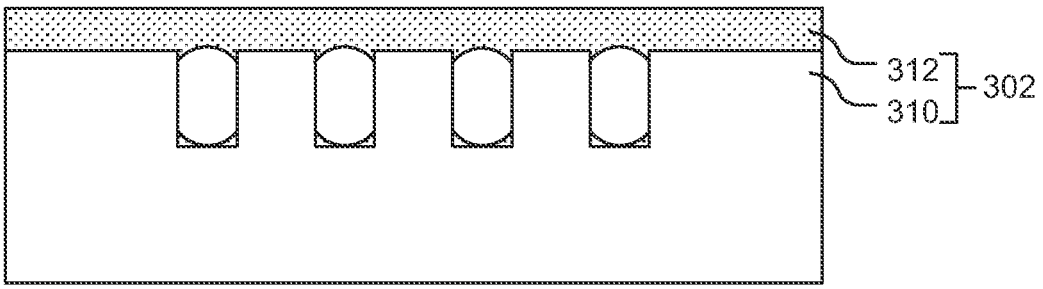

In various implementations, after growing the epitaxial layer 312, the substrate 302 may be annealed, as illustrated in FIG. 7. Annealing may operate to heal any damage in the epitaxial layer 312 and/or smooth the profile of the epitaxial layer 312 as illustrated. In some implementations, the annealing operation may comprise heating the substrate 302 at about 1,100° C. for about 2 hours. In other implementations, the annealing operation may be omitted altogether.

Figure 8:
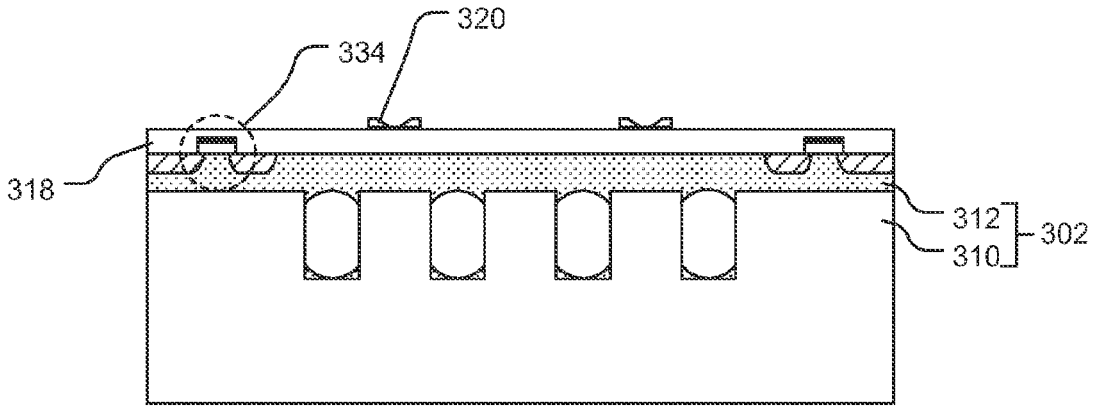

At FIG. 8, a circuit layer 318 may be formed over the epitaxial layer 312 of the substrate 302 such that the epitaxial layer 312 is between the circuit layer 318 and the bulk layer 310. In various implementations, the circuit layer 318 may comprise one or more thin films for forming an inkjet fluid ejection apparatus such as, for example, a thermal inkjet apparatus. The circuit layer 318 may comprise transistors 334 such as, for example, transistors and other logic. The circuit layer 318 may also comprise actuators 320.

Figure 9:
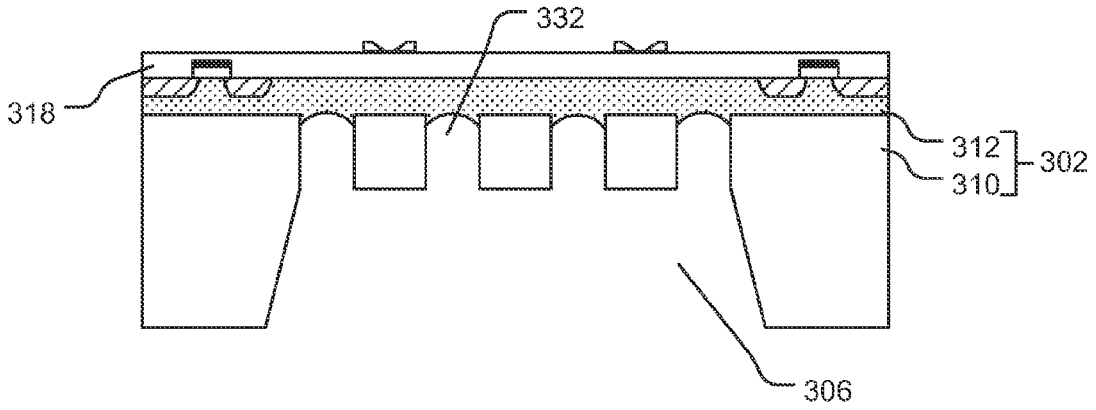

At FIG. 9, the fluid feed slot 306 may be formed in the bulk layer 310 of the substrate 302. The fluid feed slot 306 may be formed by performing a backside etch through the bulk layer 310 to the holes 332. In various implementations, the etch may comprise a laser etch, wet etch (such as, e.g., TMAH), dry etch, or a combination thereof, to open the backside of the bulk layer 310. In various implementations, a protective coating (not illustrated) such as, for example, silicon nitride, may be formed over the circuit layer 318 before forming the fluid feed slot 308.

Figure 10:
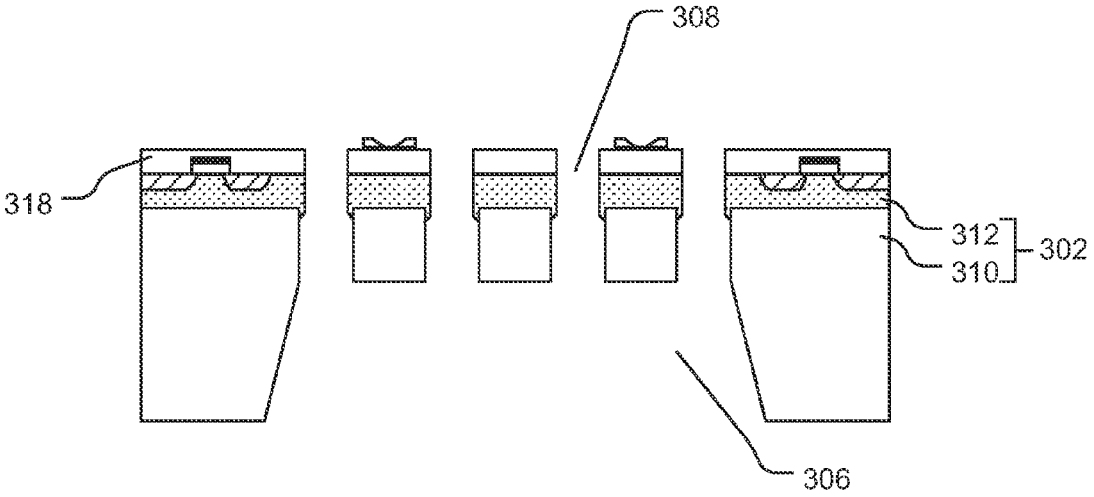

At FIG. 10, the plurality of ink feed channels 308 may be formed in at least the epitaxial layer 312 of the substrate 302. As illustrated, the ink feed channels 308 may be formed partly in the epitaxial layer 312 and partly in the bulk layer 310. In various implementations, the ink feed channels 308 may be formed by etching through the circuit layer 318 and the epitaxial layer 312 to the fluid feed slot 306. In other implementations, the ink feed channels 308 may be formed by etching through the backside of the substrate 302 through the fluid feed slot 306, epitaxial layer 312, and the circuit layer 318. The ink feed channels 308 may be formed using a dry etch or a wet etch.

The method may proceed with forming a plurality of drop generators over the substrate 302 such that the epitaxial layer 312 of the substrate 302 is between the plurality of drop generators and the bulk layer 310 and such that the each of the drop generators is fluidically coupled to the fluid feed slot 306 by at least one of the ink feed channels 308 to form, for example, a fluid ejection apparatus similar to the apparatus 100 of FIG. 1 or apparatus 200 of FIG. 2. With reference to the implementation described by FIG. 2, for example, in various implementations, forming the plurality of drop generators 204 may comprise forming the plurality of drop generators 204 such that each of the drop generators 204 is fluidically coupled with the fluid feed slot 206 by two ink feed channels 208 separated from each other by a portion of the substrate 202, wherein at least one of the actuators 220 is disposed on the portion of the substrate 202 between the two ink feed channels 208. In various implementations, the drop generators 204 may be formed by forming the orifice layer 222 over the substrate 202 to define, at least in part, a plurality of nozzles 214 and corresponding vaporization chambers 216, each of the vaporization chambers 216 fluidically coupled to the fluid feed slot 206 by at least one of the ink feed channels 208.

Figure 11:
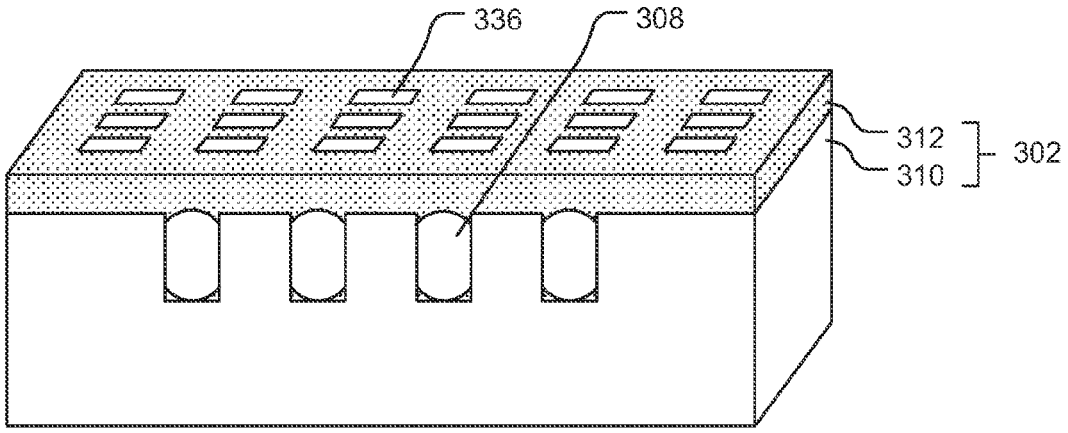
Figure 12:
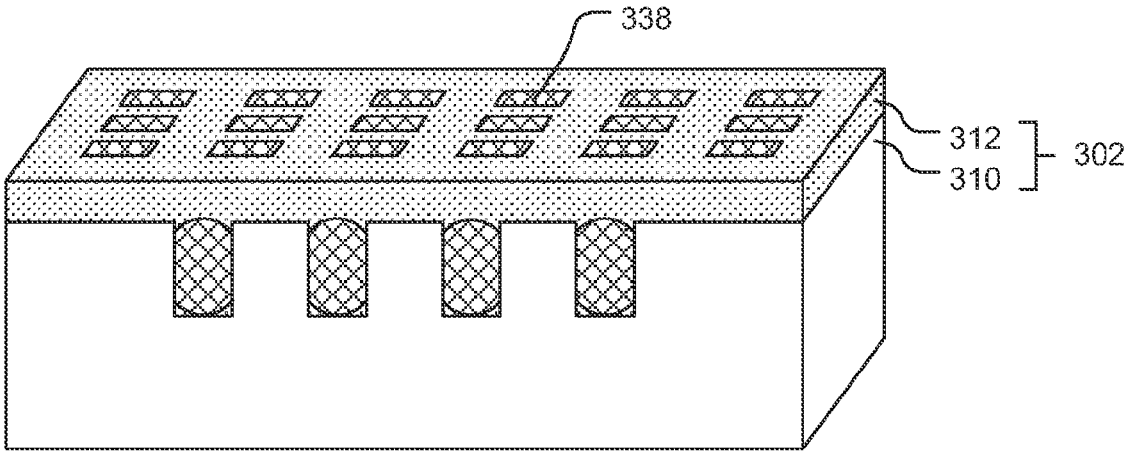

In some implementations, after forming the holes 332 at illustrated in FIG. 6, the method may instead proceed to FIG. 11 with forming trenches 336 through the epitaxial layer 312 to the holes 308, and then filling the trenches 336 and holes 308 with an oxide 338 as illustrated in FIG. 12. In various ones of these implementations, the oxide 338 may help avoid possible issues with processing the substrate 302 with holes 308 filled only with gas. High-temperature front-end processing, for example, may cause the gas to expand and may result in yield loss. At least some of the trenches 336 may be used later for forming the ink feed channels. In various implementations, the oxide 338 may be formed by flowing oxygen through the trenches 336 and holes 308. The method may then proceed with one or more other operations such as those described herein with reference to FIGS. 8-10.

Figure 13:
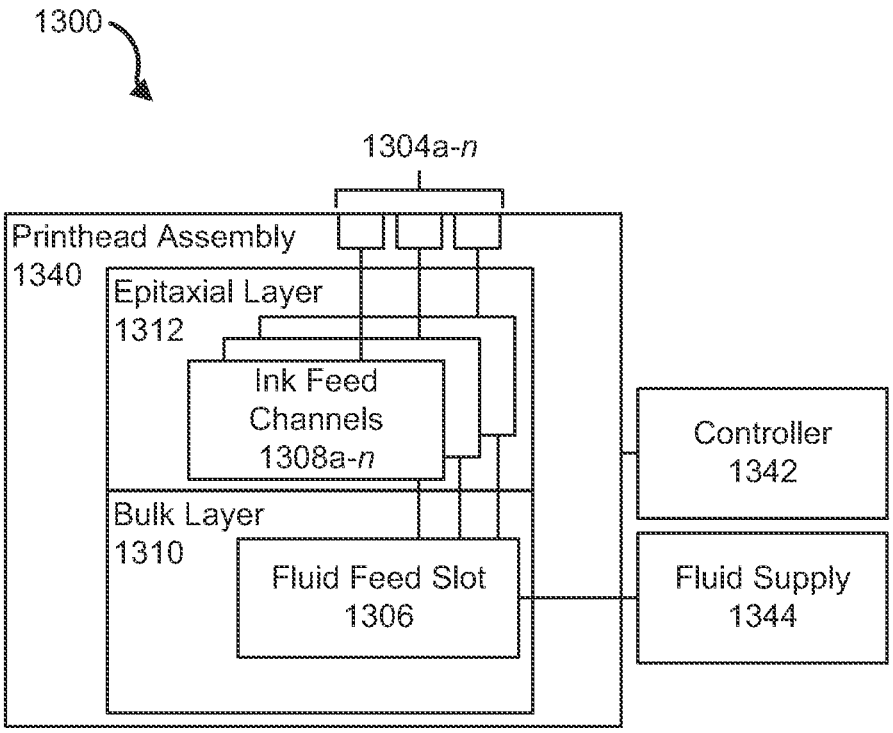
FIG. 13 is a block diagram of another example fluid ejection apparatus.

FIG. 13 is a block diagram of yet another example fluid ejection apparatus 1300 comprising a substrate described herein. As illustrated, the apparatus 1300 may include a printhead assembly 1340, a controller 1342, and a fluid supply 1344. The printhead assembly 1340 may include a plurality of drop generators 1304*a-n*, the bulk layer 1310 including a fluid feed slot 1306, and the epitaxial layer 1312 including a plurality of ink feed channels 1308*a-n* fluidically coupling the drop generators 1304*a-n* to the fluid feed slot 1306.

The controller 1342 may be configured to control ejection of fluid by the printhead assembly 1340. In various implementations, the controller 1342 may comprise one or more processors, firmware, software, one or more memory components including volatile and non-volatile memory components, or other printer electronics for communicating with and controlling the printhead assembly 1340. The controller 1342 may be configured to communicate with and control one or more other components such as, but not limited to, a mounting assembly (not illustrated) to position the printhead assembly 1340 relative to a media transport assembly (not illustrated), which may position a print media relative to the printhead assembly 1340.

In some implementations, the controller 1342 may control the printhead assembly 1340 for ejection of ink drops from one or more of the drop generators 1304*a-n*. The controller 1342 may define a pattern of ejected ink drops that form characters or images onto a medium. The pattern of ejected ink drops may be determined by a print job command and/or command parameter from data, which may be provided by a host system to the controller 1342.

The fluid supply 1344 may supply fluid to the printhead assembly 1340. In some implementations, the fluid supply 1344 may be included in the printhead assembly 1340, rather than separate as illustrated. In various implementations, the fluid supply 1344 and the printhead assembly 1340 may form either a one-way ink delivery system or a recirculating ink delivery system. In a one-way ink delivery system, substantially all of the ink supplied to inkjet printhead assembly 1340 may be consumed during printing. In a recirculating ink delivery system, however, only a portion of the ink supplied to the printhead assembly 1340 may be consumed during printing and ink not consumed during printing may be returned to the fluid supply 1344.

Various aspects of the illustrative embodiments are described herein using terms commonly employed by those skilled in the art to convey the substance of their work to others skilled in the art. It will be apparent to those skilled in the art that alternate embodiments may be practiced with only some of the described aspects. For purposes of explanation, specific numbers, materials, and configurations are set forth in order to provide a thorough understanding of the illustrative embodiments. It will be apparent to one skilled in the art that alternate embodiments may be practiced without the specific details. In other instances, well-known features are omitted or simplified in order not to obscure the illustrative embodiments.

The phrases "in an example," "in various examples," "in some examples," "in various embodiments," and "in some embodiments" are used repeatedly. The phrases generally do not refer to the same embodiments; however, they may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B". The phrase "at least one of A, B, and C" means (A), (B), (C), (A and B), (A and C), (B and C), or (A, B and C). The phrase "(A) B" means (B) or (A and B), that is, A is optional. Usage of terms like "top", "bottom", and "side" are to assist in understanding, and they are not to be construed to be limiting on the disclosure.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. It is manifestly intended, therefore, that embodiments be limited only by the claims and the equivalents thereof.

What is claimed is:

1. A method of making a fluid ejection apparatus, comprising:

providing a substrate including a bulk layer and an epitaxial layer on the bulk layer;

forming a fluid feed slot in a bulk layer of a substrate, comprising;

forming a plurality of trenches in the bulk layer;

growing the epitaxial layer over the trenches to form corresponding holes in the substrate; and performing a backside etch through the bulk layer to the holes to form the fluid feed slot;

forming a plurality of ink feed channels in at least an epitaxial layer of the substrate, each of the ink feed channels fluidically coupled to the fluid feed slot; and forming a plurality of drop generators over the substrate such that the epitaxial layer of the substrate is between the plurality of drop generators and the bulk layer and such that the each of the drop generators is fluidically coupled to the fluid feed slot by at least one of the ink feed channels.

2. The method of claim 1, further comprising annealing the substrate after said growing the epitaxial layer and before said etching through the bulk layer.

3. The method of claim 1, further comprising forming a circuit layer including a plurality of actuators over the epitaxial layer such that the epitaxial layer is between the circuit layer and the bulk layer.

4. The method of claim 3, wherein said forming the circuit layer is performed after said forming the fluid feed slot and before said forming the plurality of ink feed channels, and wherein said forming the plurality of ink feed channels comprises etching through the circuit layer and the epitaxial layer to the fluid feed slot.

5. The method of claim 1, wherein said forming the plurality of drop generators comprises forming the plurality of drop generators such that each of the drop generators is fluidically coupled with the fluid feed slot by two ink feed channels separated from each other by a portion of the substrate, wherein at least one of the actuators is disposed on the portion of the substrate between the two ink feed channels.

6. The method of claim 1, wherein said forming the plurality of drop generators comprises forming an orifice layer over the substrate to define, at least in part, a plurality of nozzles and corresponding vaporization chambers, each of the vaporization chambers fluidically coupled to the fluid feed slot by at least one of the ink feed channels.

7. A fluid ejection apparatus comprising:

a substrate including a bulk layer and an epitaxial layer on the bulk layer;

a plurality of drop generators over the substrate such that the epitaxial layer is between the plurality of drop generators and the bulk layer, each of the drop generators of the plurality including an actuator;

a fluid feed slot defined in the bulk layer of the substrate; and a plurality of ink feed channels defined, at least in part, in the epitaxial layer of the substrate, each of the drop generators fluidically coupled to the fluid feed slot by two of the ink feed channels that are separated from each other by a portion of the substrate, wherein the actuator of each of the drop generators is disposed on the portion of the substrate.

8. The apparatus of claim 7, wherein the actuator comprises a resistive element.

9. The apparatus of claim 7, wherein each of the drop generators includes a nozzle and a vaporization chamber.

10. The apparatus of claim 9, wherein each of the vaporization chambers fluidically couples the fluid feed slot to a corresponding one of the nozzles.

11. The apparatus of claim 9, further comprising an orifice layer supported by the substrate and defining, at least in part, the nozzles and vaporization chambers of the drop generators.

12. The apparatus of claim 7, further comprising a controller to control ejection of fluid by the fluid ejection apparatus, and a fluid supply to supply the fluid to the fluid feed slot.

* * * * *